United States Patent [19]

Moeddel

[11] Patent Number: 4,515,705

[45] Date of Patent: May 7, 1985

[54] COMPOSITIONS CONTAINING ODOR PURIFIED PROTEOLYTIC ENZYMES AND PERFUMES

[75] Inventor: Robert W. Moeddel, Cincinnati, Ohio

[73] Assignee: The Procter & Gamble Company, Cincinnati, Ohio

[21] Appl. No.: 591,622

[22] Filed: Mar. 20, 1984

Related U.S. Application Data

[63] Continuation-in-part of Ser. No. 551,378, Nov. 14, 1983, abandoned.

[51] Int. Cl.[3] ..... C11D 7/42; C11D 3/50

[52] U.S. Cl. ..... 252/174.12; 252/174.11; 252/522 A; 252/522 R; 252/DIG. 12; 435/187; 435/219; 435/264; 435/816

[58] Field of Search ..... 252/174.12, 174.11, 252/DIG. 12, 522 R, 522 A; 435/264, 187, 219, DIG. 816

[56] References Cited

U.S. PATENT DOCUMENTS

| | | | |
|---|---|---|---|
| 3,691,015 | 9/1972 | Leidholdt | 435/816 |
| 3,761,420 | 9/1973 | Bogardus | 252/DIG. 12 |
| 4,264,738 | 4/1981 | Stepanov et al. | 435/219 |
| 4,318,818 | 3/1982 | Letton et al. | 252/174.12 |
| 4,322,308 | 3/1982 | Hooper et al. | 252/174.11 |
| 4,326,967 | 4/1982 | Melville | 252/174.11 |

FOREIGN PATENT DOCUMENTS

| | | |
|---|---|---|
| 1815862 | 10/1970 | Fed. Rep. of Germany . |
| 57-85900 | 5/1982 | Japan . |
| 57-85898 | 5/1982 | Japan . |
| J58-117295 | 7/1983 | Japan . |

OTHER PUBLICATIONS

Enzymes–Dixon and Webb, 1964, Academic Press Inc., New York, p. 27.

Precipitation of the Enzymes and Their Stability in High Alcohol Concentrations, Bauer et al., Israel J. Chem., 5(3), 117–20, (1967), (Abstract).

Enzyme Preparations, Sugiura et al., Yakusaigaku, 1967, 27(2), 135–9, (Abstract).

*Primary Examiner*—John E. Kittle

*Assistant Examiner*—Mukund J. Shah

*Attorney, Agent, or Firm*—Donald E. Hasse; Robert B. Ayler; Thomas H. O'Flaherty

[57] ABSTRACT

Compositions containing proteolytic enzymes having no detectable odor at a concentration of less than about 0.002 Anson units per gram of distilled water, and selected perfume materials for improved odor. Heavy-duty liquid detergents are preferred.

10 Claims, No Drawings

COMPOSITIONS CONTAINING ODOR PURIFIED PROTEOLYTIC ENZYMES AND PERFUMES

REFERENCE TO RELATED APPLICATION

This application is a continuation-in-part of U.S. patent application Ser. No. 551,378, filed Nov. 14, 1983, now abandoned.

TECHNICAL FIELD

The present invention relates to compositions containing odor purified proteolytic enzymes (proteases) and selected perfumes. The compositions are preferably heavy-duty liquid detergents, but can be any household product incorporating both proteases and perfumes, including hand creams, lotions, bar soaps, liquid soaps, granular detergents, and light-duty liquid detergents.

A significant drawback to the use of enzymes in household products is the unpleasant odor contribution of traditional quality enzyme stocks. These enzyme stocks are complex mixtures obtained from fermentation processes. They usually contain significant levels of offensive odor contaminants and color bodies. Proteases have a particularly strong and objectionable odor. This drawback has, in the past, often been countered either by limiting the level of enzyme used in the product or by attempting to mask the enzyme odor with perfume oils. Limiting enzyme levels restricts product efficacy. Perfume masking is not fully effective, and can be limited by cost and product aesthetics.

The present invention uses highly refined, odor purified protease stocks in conjunction with selected perfumes to reduce or eliminate protease malodors. This provides the formulator with greater flexibility in the selection of optimum protease levels.

BACKGROUND ART

U.S. Pat. No. 4,318,818, Letton et al., issued Mar. 9, 1982, discloses heavy-duty liquid detergents containing enzymes, preferably proteases, and an enzyme-stabilizing system comprising calcium ion and a low molecular weight carboxylic acid or salt, preferably a formate. The compositions can contain various surfactants and optional detergent ingredients, including perfumes.

Pending U.S. patent application Ser. No. 537,321, Mao, filed Sept. 29, 1983, discloses light duty liquid detergents containing proteases and mild detergent surfactants.

SUMMARY OF THE INVENTION

This invention relates to compositions comprising:

(a) a proteolytic enzyme in an amount sufficient to provide an activity of from about 0.005 to about 0.1 Anson units per gram of composition, said enzyme having no detectable odor at a concentration of less than about 0.002 Anson units per gram of distilled water; and (b) from about 0.001% to about 2% by weight of a perfume selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxy citronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethylcyclopenta-gamma-2-benzopyrane, 4-acetyl-6-tertiarybutyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, orthotertiary-butyl cyclohexyl acetate, 2-methyl-3-(paraiso-propylphenyl)propionaldehyde, trichloro methyl phenyl carbinyl acetate, nonane, diol-1,3-acetate, methyl dihydro jasmonate, phenoxy ethyl iso butyrate, citronella, citronellal, citrathal, tetrahydromuguol, ethylene brassylate, musk ketone, musk tibetine, phenyl ethyl acetate, oakmoss 25%, hexyl salicylate, eucalyptol, and mixtures thereof.

PROTEOLYTIC ENZYME

The compositions of the present invention contain a proteolytic enzyme in an amount sufficient to provide an activity of from about 0.005 to about 0.1, preferably from about 0.01 to about 0.07, most preferably from about 0.012 to about 0.04, Anson units per gram of composition.

Suitable proteolytic enzymes include the many species known to be adapted for use in detergent compositions. Commercial enzyme preparations such as "Alcalase" sold by Novo Industries, and "Maxatase" sold by Gist-Brocades, Delft, The Netherlands, are suitable. Other preferred enzyme compositions include those commercially available under the tradenames SP-72 ("Esperase") manufactured and sold by Novo Industries, A/S, Copenhagen, Denmark and "AZ-Protease" manufactured and sold by Gist-Brocades, Delft, The Netherlands.

The proteases herein are purified, prior to incorporation in the finished composition, so that they have no detectable odor at a concentration of less than about 0.002 Anson units per gram of distilled water. They preferably have no detectable odor at a concentration of less than about 0.0025, more preferably less than about 0.003, Anson units per gram per liter of distilled water. As used herein, a "threshold odor detection concentration" is determined by averaging the concentrations at which a panel of at least 3 expert graders first detects protease odor moving from more dilute to less dilute solutions of protease preparations in distilled water.

Proteases herein can be odor purified by any method known in the art. Examples include the solvent precipitation methods described in *Precipitation of the Enzymes and Their Stability in High Alcohol Concentrations* by Bauer et al in the Israel J. Chem. 5(3), pages 117–20 (1967) and *Enzyme Preparations* by Sugiura et al and Yakusaigaku 1967, Volume 27(2), pages 135–9.

Solvent initiated precipitation of a crude commercial enzyme solution results in most of the enzymatic activity being precipitated from solution and most of the odor and color impurities remaining in the supernatant liquid. Decantation or centrifugation of the supernatant liquid from the precipitated enzyme results in an enzyme fraction with enriched enzymatic activity/gram and improved odor and color.

Various solvents or solvent pair combinations can be used to effect the desired precipitation. For example, methanol, ethanol, acetone, other organic solvents, and combinations of organic solvents with and without water can be used. A highly preferred solvent is a combination of water and 30–70% by weight ethanol. This appears to be optimal to prevent enzyme deactivation and maximum recovery of activity.

The purified enzymes herein also provide benefits in the area of product color stability.

PERFUME

The compositions contain from about 0.001% to about 2%, preferably from about 0.01% to about 1%, more preferably from about 0.2% to about 0.5%, by weight of a perfume selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxy citronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethylcyclopenta-gamma-2-benzopyrane, 4-acetyl-6-tertiarybutyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, orthotertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetine, phenyl ethyl acetate, oakmoss 25%, hexyl salicylate, eucalyptol, and mixtures thereof.

These perfume materials are commercially available and well known to perfumers in the detergency area. Their use in conjunction with odor purified proteases can noticeably improve the odor of household products containing enzymes. Alternatively, products having comparable odor characteristics can be obtained using higher levels of enzymes.

Preferred perfume materials are those that provide the largest odor improvements in finished product compositions containing the purified proteases herein. These perfumes include phenyl ethyl alcohol, linalool, geraniol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, para-iso-propyl alpha-octyl hydrocinnamic aldehyde, hexyl cinnamic aldehyde, hydroxy citronellal, heliotropin, citral, dextro limonene, ionone gamma methyl, methyl beta naphthyl ketone, gamma undecalactone, eugenol, musk xylol, 1,3,4,6,7,8-hexahydro-4,6,6,7,8,8-hexamethyl-cyclopenta-gamma-2-benzopyrane, 4-acetyl-6-tertiary-butyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, benzyl iso engenol, amyl cinnamic aldehyde, beta gamma hexenol, ortho-tertiary-butyl cyclohexyl acetate, trichloro methyl phenyl carbinyl acetate, nonane diol-1,3-acetate, methyl dihydro jasmonate, citrathal, ethylene brassylate, oakmoss 25%, and mixtures thereof.

Particularly preferred of the above group are phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxy citronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

OPTIONAL INGREDIENTS

Detergent compositions of the present invention can include any ingredients known for use in such compositions. For example, they contain from about 1% to about 75%, preferably from about 10% to about 50%, more preferably from about 15% to about 40%, by weight of a detergent surfactant. The surfactant can be selected from the various nonionic, anionic, cationic, zwitterionic and amphoteric surfactants, such as those described in U.S. Pat. No. 4,318,818, Letton et al., issued Mar. 9, 1982, incorporated herein by reference.

Preferred anionic surfactants are $C_{10}$–$C_{18}$ (preferably $C_{12}$–$C_{16}$) alkyl sulfates containing an average of from 0 to about 4 ethylene oxide units per mole of alkyl sulfate, $C_9$–$C_{15}$ (preferably $C_{11}$–$C_{13}$) alkylbenzene sulfonates, $C_{12}$–$C_{18}$ paraffin sulfonates, $C_{12}$–$C_{18}$ alkyl glyceryl ether sulfonates and esters of alpha-sulfonated $C_{12}$–$C_{18}$ fatty acids.

Preferred nonionic surfactants are ethoxylated alcohols of the formula $R^1(OC_2H_4)_nOH$, wherein $R^1$ is a $C_{10}$–$C_{16}$ alkyl group or a $C_8$–$C_{12}$ alkyl phenyl group, n is from about 3 to about 9, and said nonionic surfactant has an HLB (hydrophile-lipophile balance) of from about 10 to about 13. Particularly preferred are condensation products of $C_{12}$–$C_{15}$ alcohols with from about 3 to about 7 moles of ethylene oxide per mole of alcohol, e.g., $C_{12}$–$C_{13}$ alcohol condensed with about 6.5 moles of ethylene oxide per mole of alcohol.

Preferred liquid detergents herein also contain an enzyme stabilizing system, which preferably is a mixture of a short chain carboxylic acid salt and calcium ion, as described in the above Letton et al patent.

The short chain carboxylic acid salt is preferably water-soluble, and most preferably is a formate, e.g., sodium formate. The short chain carboxylic acid salt is used at a level from about 0.25% to about 10%, preferably from about 0.3% to about 3%, more preferably from about 0.5% to about 2.0%. At the higher product pH's (8.5–10), only formates are suitable.

Any water-soluble calcium salt can be used as a source of calcium ion, including calcium acetate, calcium formate and calcium propionate. The composition should contain from about 0.01 to about 30 millimoles of calcium ion per liter, preferably from about 0.1 to about 15 millimoles of calcium ion per liter. When materials are present which complex calcium ion, such as detergent builders, it is necessary to use high levels of calcium ion so that there is always some minimum level available for the enzyme. However, excellent enzyme stability is achieved with very low levels of calcium ion when the formates are used, especially at a low pH (less than about 8.5).

The pH of preferred heavy-duty liquid detergents herein is from about 6.5 to about 10, preferably from about 7 to about 8.5. Suitable pH buffers include mono-, di- and triethanolamines. When the product pH is from about 8.5 to about 10, triethanolamine is the preferred buffer. When soap or fatty acid is present, the preferred pH is from about 7 to about 8.5.

Preferred heavy-duty liquid detergents can also contain other enzymes, particularly amylases such as "Rapidase" sold by Gist-Brocades and "Termamyl" sold by Novo Industries. Purifying amylases, using methods described herein for purifying proteases, can also provide some finished product odor and/or color benefits. However, amylases are inherently less odorous and are typically used at much lower levels than the proteases, so malodors are generally not as severe.

Preferred light-duty dishwashing liquid compositions herein are described in pending U.S. patent application Ser. No. 537,321, Mao, filed Sept. 29, 1983. The present invention can also be used in the dishwashing liquid detergents described in U.S. Pat. No. 4,133,779, Hellyer et al., issued Jan. 9, 1979, and in U.S. Pat. No. 4,316,824, Pancheri, issued Feb. 23, 1982, both incorporated herein by reference.

The present invention is also useful in skin conditioning compositions such as those described in U.S. Pat. No. 4,370,319, Chapin et al., issued Jan. 25, 1983, incorporated herein by reference.

The following examples illustrate the compositions of the present invention. All parts, percentages, and ratios used herein are by weight unless otherwise specified.

EXAMPLE I

Commercially available and odor purified protease solutions were diluted in distilled water to concentrations of 1%, 0.5%, 0.25%, 0.125%, 0.0625% and 0.03125%. The solutions were compared with distilled water by a panel of expert graders, starting at the 0.03125% solution and moving toward more concentrated solutions, to determine a threshold odor detection concentration (TODC). The results were as follows.

| | Initial Activity (Anson units/g) | TODC (%) | Activity at TODC (Anson units/g) |
|---|---|---|---|
| MAXATASE | 2.0 | 0.03125 | 0.00063 |
| MAXATASE (purified) | 2.0 | 0.25 | 0.005 |
| ALCALASE | 2.5 | 0.0625 | 0.00156 |
| ALCALASE (purified) | 2.5 | 0.125* | 0.00313 |

*Average of 3 samples.

These results demonstrate that purifying commercial grade protease solutions, particularly MAXATASE, provides a significant reduction in enzyme odor. An improvement in enzyme color was also noted for the purified proteases.

In a similar comparison between commercially available and purified grades of the alpha-amylase TERMAMYL (activities from 305–326 KNu/g), no reduction in odor was noted but an improvement in color was observed.

When the above protease solutions were added to the following heavy-duty liquid detergents, a TODC of 0.03125% was judged to result in unacceptable enzyme odor, a TODC of 0.0625% was judged to result in borderline acceptable enzyme odor, and a TODC of 0.125% was judged to result in acceptable enzyme odor.

| Components | Wt. % |
|---|---|
| Composition A | |
| Sodium $C_{12-14}$ alkylethoxylate (1) sulfate | 9.4 |
| (on an acid basis) | (8.8) |
| $C_{12-13}$ alkylpolyethoxylate (6.5) | 21.5 |
| Ethanol | 5.7 |
| Sodium diethylenetriamine pentaacetate | 0.2 |
| MAXATASE | 0.026 Anson units/g |
| TERMAMYL | 0.51 KNu/g |
| Sodium formate | 1.6 |
| Calcium formate | 0.1 |
| Water and minors | Balance to 100 |
| pH | 7.5 |
| Composition B | |
| $C_{14-15}$ alkyl polyethoxylate (7)* | 18.0 |
| Coconut alkyl dimethylamine oxide | 1.0 |
| Ditallow dimethylammonium chloride** | 3.0 |
| TEPA-$E_{15-18}$*** | 1.5 |
| Ethanol | 7.5 |
| MAXATASE | 0.015 Anson units/g |
| TERMAMYL | 0.51 KNu/g |
| Sodium formate | 1.2 |
| Calcium chloride | 0.025 |
| Water and minors | Balance to 100 |
| pH | 7.0 |

*The alcohol and monoethoxylated alcohol have been removed.
**60–65% unsaturated tallow.
***Tetraethylene pentaimine ethoxylated with 15–18 moles (avg.) of ethylene oxide at each hydrogen site.

EXAMPLE II

A commercially available MAXATASE stock solution having a threshold odor detection concentration of 0.03125% or an odor purified MAXATASE solution having a threshold odor detection concentration of 0.125%, each having an initial activity of 2.0 Anson units per gram, was added to samples of Composition A of Example I (less the enzymes) at a level sufficient to provide an activity of 0.026 Anson units per gram of composition. Each sample contained 0.1% by weight of the perfume indicated below, except for the 1,3,4,6,7,8-hexahydro-4,6,6,7,8,8-hexamethylcyclopenta-gamma-2-benzopyrane, which was present at 0.05%.

The samples were graded for odor by a panel of 5 or 6 expert graders using the following 1–10 scale.

| Grade | Definition |
|---|---|
| 10.0 | Best quality possible. Excellent product. |
| 9.0 | Odor mostly perfume. Enzyme odor slight. Very good product. |
| 8.0 | Odor mostly perfume. Enzyme more apparent. Good product. |
| 7.0 | Odor low on perfume. Enzyme more apparent. |
| 6.0 | Odor low on perfume. Enzyme and/or alien odor significant. Low quality product. |
| 5.0 | Perfume very low. Enzyme and/or alien odor strong. Poor product. |
| 4.0 and below | No apparent perfume. Enzyme or alien odors overpowering. Very poor product. |

The samples were again graded after 12 days and after 35 days. The results, after averaging the grades, were as follows.

TABLE I

| Perfume | Fresh Samples | | | After 12 days | | | After 35 days | | |
|---|---|---|---|---|---|---|---|---|---|
| | Purified | Stock | Δ | Purified | Stock | Δ | Purified | Stock | Δ |
| Phenyl ethyl alcohol | 8.5 | 3.5 | 5.0 | 7.5 | 5.0 | 2.5 | 8.0 | 5.0 | 3.0 |
| Linalool | 9.0 | 4.0 | 5.0 | 9.0 | 5.5 | 3.5 | 8.0 | 4.5 | 3.5 |
| Geraniol | 9.0 | 5.0 | 4.0 | 8.0 | 6.0 | 2.0 | 8.0 | 4.5 | 3.5 |
| Alpha terpineol | 6.0 | 9.0 | −3.0 | 5.0 | 8.0 | −3.0 | 5.0 | 8.0 | −3.0 |
| Citronellol | 8.0 | 7.0 | 1.0 | 8.0 | 7.5 | 0.5 | 8.0 | 7.0 | 1.0 |
| Cinnamic alcohol | 8.0 | 5.5 | 2.5 | 8.0 | 5.5 | 2.5 | 8.0 | 6.0 | 2.0 |
| Iso bornyl acetate | 7.5 | 6.0 | 1.5 | 9.0 | 6.0 | 3.0 | 8.0 | 6.0 | 2.0 |
| Benzyl acetate | 9.0 | 6.0 | 3.0 | 9.0 | 6.5 | 2.5 | 9.0 | 6.0 | 3.0 |
| Para-tertiary-butyl cyclohexyl acetate | 9.0 | 6.0 | 3.0 | 9.0 | 7.0 | 2.0 | 8.0 | 5.0 | 3.0 |
| Linalyl acetate | 9.0 | 5.5 | 3.5 | 9.0 | 5.0 | 4.0 | 8.0 | 5.0 | 3.0 |
| Dihydro-nor-dicyclopentadienyl acetate | 9.0 | 6.0 | 3.0 | 9.0 | 7.0 | 2.0 | 8.5 | 7.5 | 1.0 |
| Dihydro-nor-dicyclopentadienyl propionate | 9.0 | 5.5 | 3.5 | 8.0 | 6.5 | 1.5 | 8.0 | 6.0 | 2.0 |
| Amyl salicylate | 7.5 | 5.0 | 2.5 | 8.5 | 5.5 | 3.0 | 7.5 | 5.0 | 2.5 |
| Benzyl salicylate | 7.0 | 4.5 | 2.5 | 7.0 | 6.0 | 1.0 | 7.0 | 5.5 | 1.5 |
| Para-iso-propyl alpha-octyl hydrocinnamic aldehyde | 8.0 | 6.0 | 2.0 | 8.5 | 6.0 | 2.5 | 8.5 | 6.0 | 2.5 |
| Hexyl cinnamic aldehyde | 8.0 | 4.5 | 3.5 | 7.5 | 4.5 | 3.0 | 7.0 | 4.5 | 2.5 |
| Hydroxy citronellal | 8.0 | 5.5 | 2.5 | 7.0 | 5.0 | 2.0 | 7.0 | 4.0 | 3.0 |
| Heliotropin | 8.0 | 7.0 | 1.0 | 8.0 | 6.0 | 2.0 | 8.5 | 6.0 | 2.5 |
| Anisaldehyde | 8.0 | 9.0 | −1.0 | 9.0 | 8.0 | 1.0 | 9.0 | 7.5 | 1.5 |
| Citral | 10.0 | 8.0 | 2.0 | 10.0 | 9.0 | 1.0 | 10.0 | 7.5 | 2.5 |
| Dextro limonene | 10.0 | 6.5 | 3.5 | 9.5 | 7.5 | 2.0 | 8.5 | 7.0 | 1.5 |
| Coumarin | 8.0 | 7.5 | 0.5 | 8.0 | 6.5 | 1.5 | 8.5 | 7.5 | 1.0 |
| Ionone gamma methyl | 10.0 | 6.0 | 4.0 | 9.5 | 7.0 | 2.5 | 9.0 | 7.0 | 2.0 |
| Methyl beta naphthyl ketone | 10.0 | 4.5 | 5.5 | 10.0 | 7.0 | 3.0 | 9.0 | 6.5 | 2.5 |
| Gamma undecalactone | 9.5 | 5.0 | 4.5 | 9.0 | 7.0 | 2.0 | 8.5 | 6.0 | 2.5 |
| Eugenol | 8.0 | 5.0 | 3.0 | 9.0 | 5.0 | 4.0 | 8.5 | 6.0 | 2.5 |
| Musk xylol | 7.5 | 3.5 | 4.0 | 8.5 | 5.5 | 3.0 | 8.0 | 6.0 | 2.0 |
| 1,3,4,6,7,8-hexahydro-4,6,6,7,8,8-hexamethyl-cyclopenta-gamma-2-benzopyrane | 8.5 | 4.5 | 4.0 | 8.0 | 5.5 | 2.5 | 7.5 | 6.0 | 1.5 |
| 4-acetyl-6-tertiary-butyl-1,1-dimethyl indan | 8.0 | 5.0 | 3.0 | 7.0 | 4.5 | 2.5 | 7.0 | 5.5 | 1.5 |
| 6-acetyl-1,1,3,4,4,6-hexamethyl tetrahydro naphthalene | 8.0 | 5.0 | 3.0 | 8.0 | 4.0 | 4.0 | 7.5 | 4.5 | 3.0 |
| Beta naphthyl ethyl ether | 7.0 | 4.0 | 3.0 | 7.0 | 4.5 | 2.5 | 6.0 | 4.0 | 2.0 |
| Methyl eugenol | 7.0 | 5.0 | 2.0 | 7.0 | 4.5 | 2.5 | 6.0 | 5.0 | 1.0 |
| Methyl cedrenyl ketone | 9.0 | 6.0 | 3.0 | 8.5 | 6.0 | 2.5 | 8.0 | 5.5 | 2.5 |
| Patchouli | 10.0 | 8.0 | 2.0 | 9.5 | 7.0 | 2.5 | 9.5 | 7.0 | 2.5 |
| Lavandin | 10.0 | 6.0 | 4.0 | 9.0 | 7.5 | 1.5 | 9.5 | 7.5 | 2.0 |
| Geranyl nitrile | 10.0 | 8.0 | 2.0 | 10.0 | 7.0 | 3.0 | 9.5 | 8.0 | 1.5 |

These results demonstrate that the use of the purified MAXATASE in conjunction with all of the perfume materials tested, except for the alpha terpineol, improves product odor.

EXAMPLE III

A commercially available MAXATASE stock solution having a threshold odor detection concentration of 0.03125% or an odor purified MAXATASE solution having a threshold odor detection concentration of 0.09375%, each having an initial activity of about 2.0 Anson units per gram, was added to samples of Composition C at a level sufficient to provide an activity of 0.022 Anson units per gram of composition. Each sample contained 0.1% by weight of the perfume indicated below in Table II.

| Composition C | |
|---|---|
| Components | Wt. % |
| Sodium $C_{12-14}$ alkylethoxylate (1) sulfate | 9.4 |
| (on an acid basis) | (8.8) |
| $C_{12-13}$ alkylpolyethoxylate (6.5) | 21.5 |
| Ethanol | 6.2 |
| Sodium diethylenetriame pentaacetate | 0.2 |
| TEPA-$E_{15-18}$* | 1.5 |
| TERMAMYL | 0.51 KNu/g |
| Sodium formate | 1.6 |
| Calcium formate | 0.1 |
| Water and minors | Balance to 100 |
| pH | 7.5 |

*Tetraethylene pentaimine ethoxylated with 15–18 moles (avg.) of ethylene oxide at each hydrogen site.

The samples were graded as described in Example II. The results, after averaging the grades, were as follows.

TABLE II

| Perfume | Purified | Stock | Δ | Purified | Stock | Δ |
|---|---|---|---|---|---|---|
| | Fresh Samples | | | After 11 days | | |
| Alpha ionone | 9.5 | 8.0 | 1.5 | 9.0 | 7.0 | 2.0 |
| Alpha beta ionone | 8.5 | 7.5 | 1.0 | 8.0 | 7.0 | 1.0 |
| Benzyl iso eugenol | 5.0 | 4.0 | 1.0 | 6.0 | 4.0 | 2.0 |
| Amyl cinnamic aldehyde | 7.0 | 5.5 | 1.5 | 7.0 | 5.0 | 2.0 |

TABLE II-continued

| Perfume | | | | | | |
|---|---|---|---|---|---|---|
| Alpha-methyl phenylacetaldehyde | 9.5 | 9.0 | 0.5 | 9.0 | 8.5 | 0.5 |
| Cis-3-hexenyl acetate | 10.0 | 9.5 | 0.5 | 9.0 | 8.5 | 0.5 |
| Roselea | 8.0 | 8.0 | 0.0 | 7.5 | 7.5 | 0.0 |
| Beta gamma hexenol | 8.5 | 8.0 | 0.5 | 8.0 | 6.0 | 2.0 |
| Intreleven aldehyde | 8.5 | 8.5 | 0.0 | 9.0 | 9.0 | 0.0 |
| Methyl iso butenyl tetra hydro pyran | 8.5 | 8.0 | 0.5 | 8.5 | 8.0 | 0.5 |
| Orange CP | 9.0 | 8.5 | 0.5 | 9.0 | 7.5 | 1.5 |
| Ortho-tertiary-butyl cyclohexyl acetate | 8.5 | 5.5 | 3.0 | 8.5 | 6.0 | 2.5 |
| 2-methyl-3-(para-iso-propyl-phenyl) propionaldehyde | 8.0 | 6.0 | 2.0 | 8.0 | 6.5 | 1.5 |
| Trichloro methyl phenyl carbinyl acetate | 9.0 | 7.5 | 1.5 | 8.0 | 5.5 | 2.5 |
| Nonane diol-1,3-acetate | 8.0 | 7.0 | 1.0 | 8.0 | 5.5 | 2.5 |
| Methyl dihydro jasmonate | 7.0 | 6.5 | 0.5 | 8.0 | 6.0 | 2.0 |
| Phenoxy ethyl iso butyrate | 9.0 | 8.0 | 1.0 | 8.0 | 6.5 | 1.5 |
| Citronella | 10.0 | 9.0 | 1.0 | 9.0 | 8.0 | 1.0 |
| Citronellal | 9.0 | 9.0 | 0.0 | 9.0 | 8.0 | 1.0 |
| Citrathal | 9.0 | 8.5 | 0.5 | 9.0 | 6.5 | 2.5 |
| Dihydromyrcenol | 8.0 | 7.0 | 1.0 | 8.0 | 7.5 | 0.5 |
| Tetrahydromuguol | 8.5 | 7.0 | 1.5 | 8.5 | 7.0 | 1.5 |
| Ethylene brassylate | 7.0 | 6.0 | 1.0 | 8.5 | 5.0 | 3.5 |
| Musk ketone | 8.5 | 8.0 | 0.5 | 7.5 | 6.5 | 1.0 |
| Musk tibetine | 8.0 | 7.5 | 0.5 | 7.0 | 5.5 | 1.5 |
| Phenyl ethyl acetate | 8.0 | 8.0 | 0.0 | 8.0 | 7.0 | 1.0 |
| Oakmoss 25% | 7.5 | 5.0 | 2.5 | 6.5 | 4.0 | 2.5 |
| Alpha terpineol | 7.0 | 8.0 | −1.0 | 6.0 | 7.0 | −1.0 |
| Linalool | 8.5 | 6.5 | 2.0 | 9.0 | 6.0 | 3.0 |
| Benzyl acetate | 9.0 | 6.5 | 2.5 | 8.0 | 6.0 | 2.0 |
| Hexyl salicylate | 8.5 | 7.0 | 1.5 | 8.0 | 7.0 | 1.0 |
| Eucalyptol | 9.5 | 7.0 | 2.5 | 8.5 | 7.0 | 1.5 |

Preferred perfume materials herein are those in Examples II and III that provide the largest odor improvements after either 11, 12 or 35 days of storage.

EXAMPLE IV

Odor purified proteases and the selected perfume materials herein are also preferably used in the following heavy-duty liquid detergent composition.

| Component | Wt. % |
|---|---|
| $C_{13}$ linear alkylbenzene sulfonic acid | 7.2 |
| $C_{14-15}$ alkyl polyethoxylate (2.25) sulfuric acid | 10.8 |
| $C_{12-13}$ alcohol polyethoxylate (6.5)* | 6.5 |
| $C_{12}$ alkyl trimethylammonium chloride | 1.2 |
| $C_{12-14}$ fatty acid | 13.0 |
| Oleic acid | 2.0 |
| Citric acid (anhydrous) | 4.0 |
| Diethylenetriamine pentaacetic acid | 0.23 |
| Protease enzyme (2.0 AU/g) | 0.75 |
| Amylase enzyme (375 Am. U/g) | 0.16 |
| TEPAE-$E_{15-18}$** | 1.5 |
| Monoethanolamine | 2.0 |
| Sodium ion | 1.66 |
| Potassium ion | 2.65 |
| Propylene glycol | 7.25 |
| Ethanol | 7.75 |
| Formic acid | 0.66 |
| Calcium ion | 0.03 |
| Minors and water | Balance to 100 |
| pH at concentration of 10% in water at 68° F. (20° C.) | 8.65 |

*Alcohol and monoethoxylated alcohol removed.
**Tetraethylene pentaimine ethoxylated with 15–18 moles (avg.) of ethylene oxide at each hydrogen site.

What is claimed is:

1. A composition of matter comprising:

(a) a proteolytic enzyme in an amount sufficient to provide an activity of from about 0.005 to about 0.1 Anson units per gram of composition, said enzyme having no detectable odor at a concentration of less than about 0.002 Anson units per gram of distilled water; and (b) from about 0.001% to about 2% by weight of a perfume selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxy citronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethylcyclopenta-gamma-2-benzopyrane, 4-acetyl-6-tertiarybutyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, orthotertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetine, phenyl ethyl acetate, oakmoss 25%, hexyl salicylate, eucalyptol, and mixtures thereof.

2. A composition according to claim 1 wherein the proteolytic enzyme provides an activity of from about 0.01 to about 0.07 Anson units per gram of composition.

3. A composition according to claim 1 wherein the proteolytic enzyme has no detectable odor at a concentration of less than about 0.0025 Anson units per gram of distilled water.

4. A composition according to claim 1 comprising a perfume selected from the group consisting of phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxy citronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

5. A heavy-duty liquid detergent composition comprising:

(a) from about 1% to about 75% by weight of a detergent surfactant selected from the group consisting of nonionic, anionic, cationic, zwitterionic and amphoteric surfactants, and mixtures thereof;

(b) a proteolytic enzyme in an amount sufficient to provide an activity of from about 0.005 to about 0.1 Anson units per gram of composition, said enzyme having no detectable odor at a concentration of less than about 0.002 Anson units per gram of distilled water; and (c) from about 0.001% to about 2% by weight of a perfume selected from the group consisting of phenyl ethyl alcohol, linalool, geraniol, citronellol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, benzyl salicylate, para-iso-propyl alpha-octyl hydrocinnamic aldehyde, hexyl cinnamic aldehyde, hydroxy citronellal, heliotropin, anisaldehyde, citral, dextro limonene, coumarin, ionone gamma methyl, methyl beta naphthyl ketone, gamma undecalactone, eugenol, musk xylol, 1,3,4,6,7,8-hexahydro-4,6,6,7,8,8-hexamethylcyclopenta-gamma-2-benzopyrane, 4-acetyl-6-tertiarybutyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, alpha beta ionone, benzyl iso eugenol, amyl cinnamic aldehyde, beta gamma hexenol, orange CP, orthotertiary-butyl cyclohexyl acetate, 2-methyl-3-(para-iso-propylphenyl)propionaldehyde, trichloro methyl phenyl carbinyl acetate, nonane diol-1,3-acetate, methyl dihydro jasmonate, phenoxy ethyl iso butyrate, citronella, citronellal, citrathal, tetrahydromuguol, ethylene brassylate, musk ketone, musk tibetine, phenyl ethyl acetate, oakmoss 25%, hexyl salicylate, eucalyptol, and mixtures thereof.

6. A composition according to claim 5 wherein the proteolytic enzyme provides an activity of from about 0.012 to about 0.04 Anson units per gram of composition.

7. A composition according to claim 6 wherein the proteolytic enzyme has no detectable odor at a concentration of less than about 0.003 Anson units per gram of distilled water.

8. A composition according to claim 7 comprising from about 0.2% to about 0.5% by weight of the perfume.

9. A composition according to claim 8 comprising a perfume selected from the group consisting of phenyl ethyl alcohol, linalool, geraniol, cinnamic alcohol, iso bornyl acetate, benzyl acetate, para-tertiary-butyl cyclohexyl acetate, linalyl acetate, dihydro-nor-dicyclopentadienyl acetate, dihydro-nor-dicyclopentadienyl propionate, amyl salicylate, para-iso-propyl alpha-octyl hydrocinnamic aldehyde, hexyl cinnamic aldehyde, hydroxy citronellal, heliotropin, citral, dextro limonene, ionone gamma methyl, methyl beta naphthyl ketone, gamma undecalactone, eugenol, musk xylol, 1,3,4,6,7,8-hexahydro-4,6,6,7,8,8-hexamethylcyclopenta-gamma-2-benzopyrane, 4-acetyl-6-tertiarybutyl-1,1-dimethyl indan, 6-acetyl-1,1,3,4,4,6-hexamethyl tetrahydro naphthalene, beta naphthyl ethyl ether, methyl eugenol, methyl cedrenyl ketone, patchouli, lavandin, geranyl nitrile, alpha ionone, benzyl iso engenol, amyl cinnamic aldehyde, beta gamma hexenol, ortho-tertiary-butyl cyclohexyl acetate, trichloro methyl phenyl carbinyl acetate, nonane diol-1,3-acetate, methyl dihydro jasmonate, citrathal, ethylene brassylate, oakmoss 25%, and mixtures thereof.

10. A composition according to claim 9 comprising a perfume selected from the group consisting of phenyl ethyl alcohol, linalool, geraniol, iso bornyl acetate, benzyl acetate, para-tertiary-butyl cyclohexyl acetate, linalyl acetate, amyl salicylate, hexyl cinnamic aldehyde, hydroxy citronellal, methyl beta naphthyl ketone, eugenol, musk xylol, 6-acetyl-1,1,3,4,4,6-hexamethyl tetrahydro naphthalene, geranyl nitrile, ethylene brassylate, and mixtures thereof.

* * * * *